US006646621B1

(12) United States Patent
Phelan et al.

(10) Patent No.: US 6,646,621 B1
(45) Date of Patent: Nov. 11, 2003

(54) SPIRAL WOUND, SERIES FED, ARRAY ANTENNA

(75) Inventors: Richard Phelan, Palm Bay, FL (US); Mark L. Goldstein, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/131,962

(22) Filed: Apr. 25, 2002

(51) Int. Cl.[7] ..... H01Q 21/00; H01Q 1/36
(52) U.S. Cl. ..... 343/895; 343/893
(58) Field of Search ..... 343/895, 700 MS, 343/795, 854, 893

(56) References Cited

U.S. PATENT DOCUMENTS 3,949,407 A * 4/1976 Jagdmann et al. ..... 343/895
4,114,164 A 9/1978 Greiser ..... 343/895
4,348,679 A 9/1982 Shnitkin et al. ..... 343/768
5,451,973 A 9/1995 Walter et al. ..... 343/895
6,067,058 A 5/2000 Volman ..... 343/895
6,184,828 B1 * 2/2001 Shoki ..... 342/372
6,204,821 B1 3/2001 Van Voorhies ..... 343/742
6,433,754 B1 * 8/2002 Boeringer ..... 343/893
6,525,697 B1 * 2/2003 Theobold ..... 343/895

* cited by examiner

*Primary Examiner*—James Clinger
(74) *Attorney, Agent, or Firm*—Allen, Dyer, Doppelt, Milbrath & Gilchrist, P.A.

(57) ABSTRACT

A phased array antenna includes a circuit board and a balanced, series fed antenna array formed from a plurality of antenna elements positioned in at least two spiral antenna arms on the circuit board. At least one signal feed point is positioned at a center portion of the spiral antenna arms for series feeding the antenna array and conducting transmitted and received signals and breaking up frequency scan and grating lobes.

26 Claims, 8 Drawing Sheets

SPIRAL WOUND, SERIES FED, ARRAY ANTENNA

FIELD OF THE INVENTION

The present invention relates to phased array antennae, and more particularly, this invention relates to series fed phased array antennae.

BACKGROUND OF THE INVENTION

Low cost phased array antennae are required on naval ships, land based radar stations and similar areas. Some traditional phased array antennae use periodic or spiral lattices and transmit/receive modules that are prohibitive in cost. When an antenna is designed for use with short wavelengths in advanced radar designs, a low side lobe architecture is required.

One type of phased array antenna architecture uses a Dual Application Program (DUAP) array structure based on a typical dual beam and corporate radio frequency and digital feed network. It typically includes a multilayer circuit board having various layers for different circuit components, including low noise amplifiers, phase shifters and other assorted feed lines, signal traces and component devices. For multiple beam and multiple polarization arrays, however, this type of antenna structure requires a complicated printed wiring board having multiple interconnects. For example, some printed wiring boards include over two thousand (2,000) vias in an 18-inch square printed circuit card, 64 elements, and two antenna beams. Not only is the layout of this array difficult to achieve, it can surpass some existing radio frequency layout tool capacities. This type of antenna architecture also requires a complicated feed network and multilayer circuit board with complicated circuit components that should not cross-over, thus, increasing design and construction difficulty.

Many phased array antennae use corporate feed networks with complicated interconnect systems because a corporate fed antenna allows a wide bandwidth. Also, in a planar array having a corporate feed network, the periodic spacing and phase settings between the antenna elements require only a simple sine calculation. The corporate feed network can typically provide an advantageous impedance match. Unfortunately, a corporate feed network is usually complicated and is often designed into an antenna structure from habit and not from advantage.

A linear, series fed array, however, will not have the complicated design drawbacks associated with a corporate feed network. Some linear, series fed arrays have been built as early as the 1940's. For example, the United States Navy built a phased array series of fed WG slot arrays used to scan the beam. These type of linear, series fed arrays, however, were limited in their use because of frequency scan effects and the grating lobes.

SUMMARY OF THE INVENTION

In view of the foregoing background, it is therefore an object of the present invention to provide a series fed array antenna that overcomes the drawbacks associated with prior art linear series fed array antennae.

It is also an object of the present invention to provide a series fed antenna array that breaks up frequency scan effects and grating lobes.

It is yet another object of the present invention to provide a low cost antenna array that simplifies layout and eliminates crossover drawbacks associated complicated corporate feed networks.

These and other objects, features and advantages in accordance with the present invention are provided by a phased array antenna that includes a circuit board and a balanced, series fed antenna array formed from a plurality of antenna elements positioned in at least two spiral antenna arms on the circuit board. At least one signal feed point is positioned at a center portion of the spiral antenna arms for series feeding the antenna array, such that the antenna aids in breaking up frequency scan and grating lobes. In one aspect of the present invention, electronic circuitry can be supported by the circuit board and operatively connected to the antenna elements for amplifying, phase shifting and beam forming any transmitted or received signals.

In another aspect of the present invention, the antenna array is formed as two balanced series fed antenna arrays, each formed as spiral antenna arms and having dual feed points. The circuit board could be formed as a multilayer circuit board having a microstrip layer operative with the antenna elements for series driving the antenna array. The number of antenna elements within each spiral antenna arm are substantially the same and can be formed as either surface mounted antenna elements or printed antenna elements.

In yet another aspect of the present invention, the plurality of antenna elements are arranged on the circuit board in four spiral antenna arms as balanced, series fed antenna arrays having signal feed points at a center portion of the spiral arm. The antenna elements can be formed as respective 0, 90, 180 and 270 degree spiral arms for phased operation.

In yet another aspect of the present invention, the phased array antenna can comprise a balanced, series fed antenna array formed from a plurality of antenna elements positioned in at least two spiral antenna arms on the circuit board and having at least one signal feed point at a center portion of the spiral antenna arms for series feeding the antenna array. The spiral arms can be formed from a waveguide having slots defining the antenna elements. If a waveguide is not used, then the antenna elements can be positioned on a planar circuit board as described before.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The present invention advantageously provides a phased array antenna that includes a balanced, series fed, phased array antenna formed from a plurality of antenna elements positioned in at least two spiral antenna arms on a circuit board. At least one signal feed point is provided at a center portion of the spiral antenna arms for series feeding the antenna array and conducting any transmitted or received signals to aid in breaking up frequency scan and grating lobes.

This new class of series fed antenna array is advantageous over prior art linear, series fed antenna arrays that do not break up the frequency scan and grating lobes as in the present invention. The present invention also simplifies the physical construction of an array antenna built on printed circuit boards and cuts non-reoccurring engineering (NRE) costs while allowing a simple layout for antenna elements, signal feed circuits, and associated components. The spiral configuration of the present invention can be applied to numerous multiple beam lengths, including TCDL, CDL-N, and DD XX structures. The design of the present invention can cut costs and non-reoccurring engineering aspects on all arrays with estimated cuts of 50% and schedule cuts of six months. Production cuts can be lowered from about 10% to about 50%.

Figure 1:
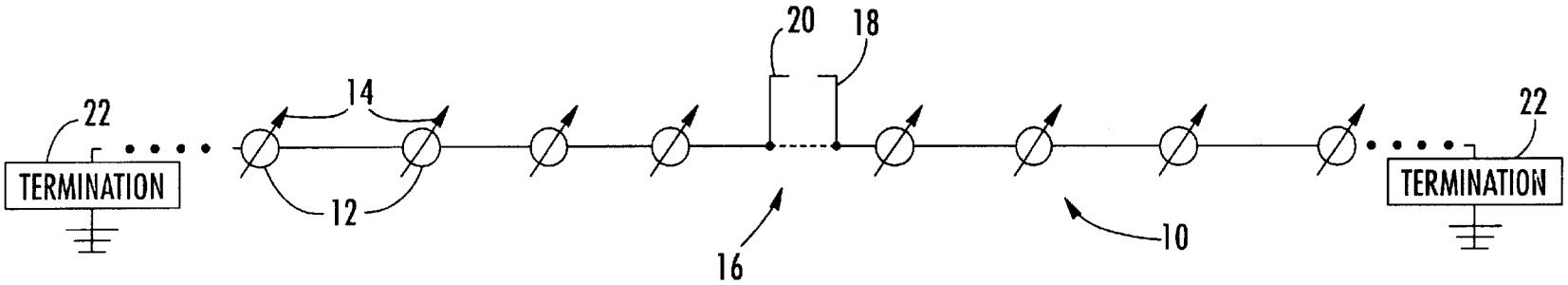
FIG. 1. (PRIOR ART)
FIG. 1 is a fragmentary view of a linear, series fed array antenna showing individual antenna elements that can be controlled by appropriate phase shift devices.

FIG. 1 illustrates at 10 a prior art linear, series fed array antenna having numerous interconnected antenna elements 12 using phase shift components 14 (shown by the arrow) and other driving elements and signal circuits as known to those skilled in the art. This type of linear, series fed array could be formed on a multilayer circuit board by techniques as known to those skilled in the art. A feed point 16 is positioned at the center of the linear array 10 and includes two signal feed line terminals 18,20 in which a signal voltage is placed across the terminals as known to those skilled in the art. The array is terminated at either end by appropriate terminations 22 to ground.

Figure 2:
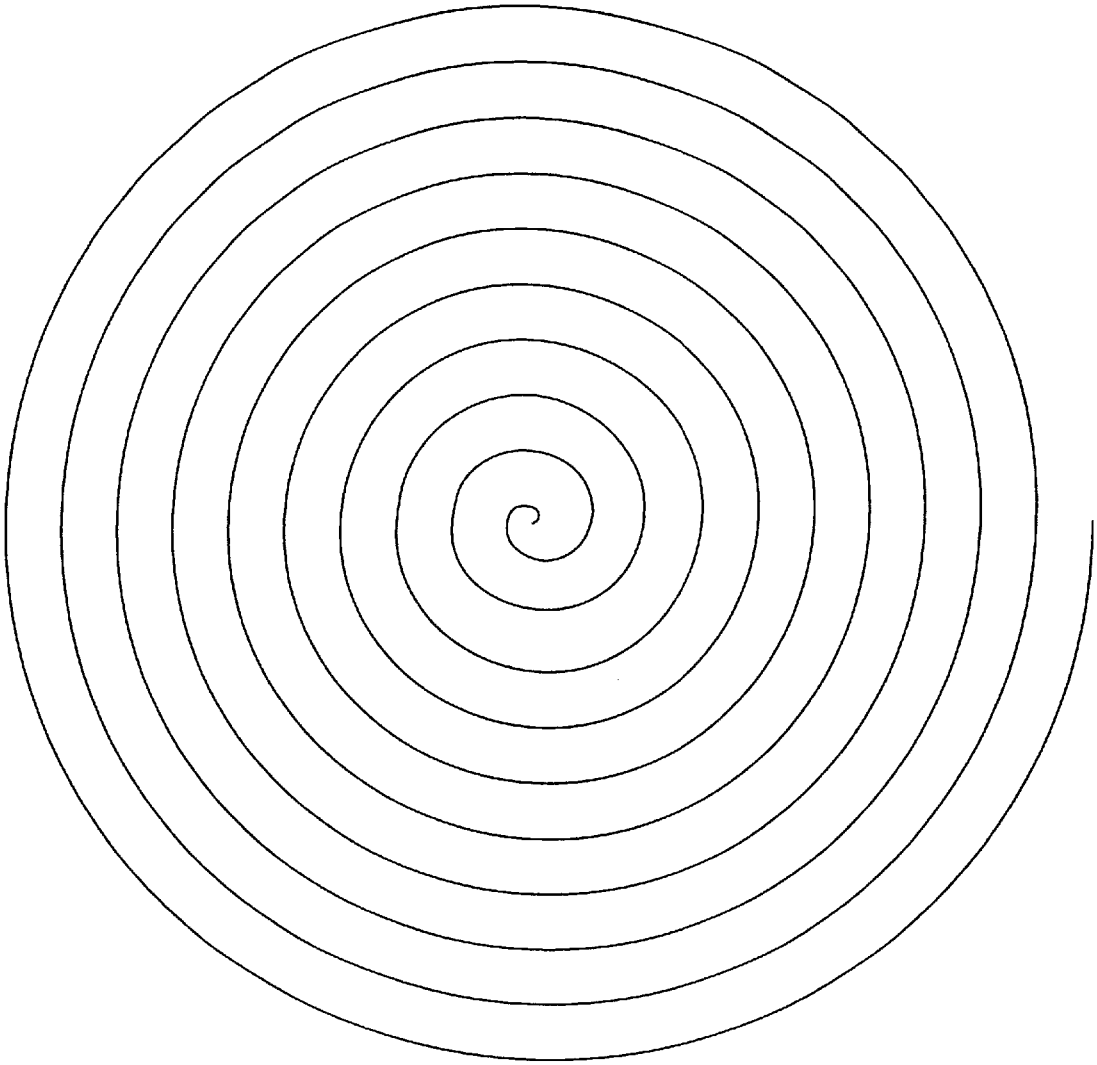
FIGS. 2–5 are fragmentary, plan views of the respective spiral arms shown as a single spiral arm in FIGS. 2 and 4 and dual spiral arms in FIGS. 4 and 5.
Figure 3:
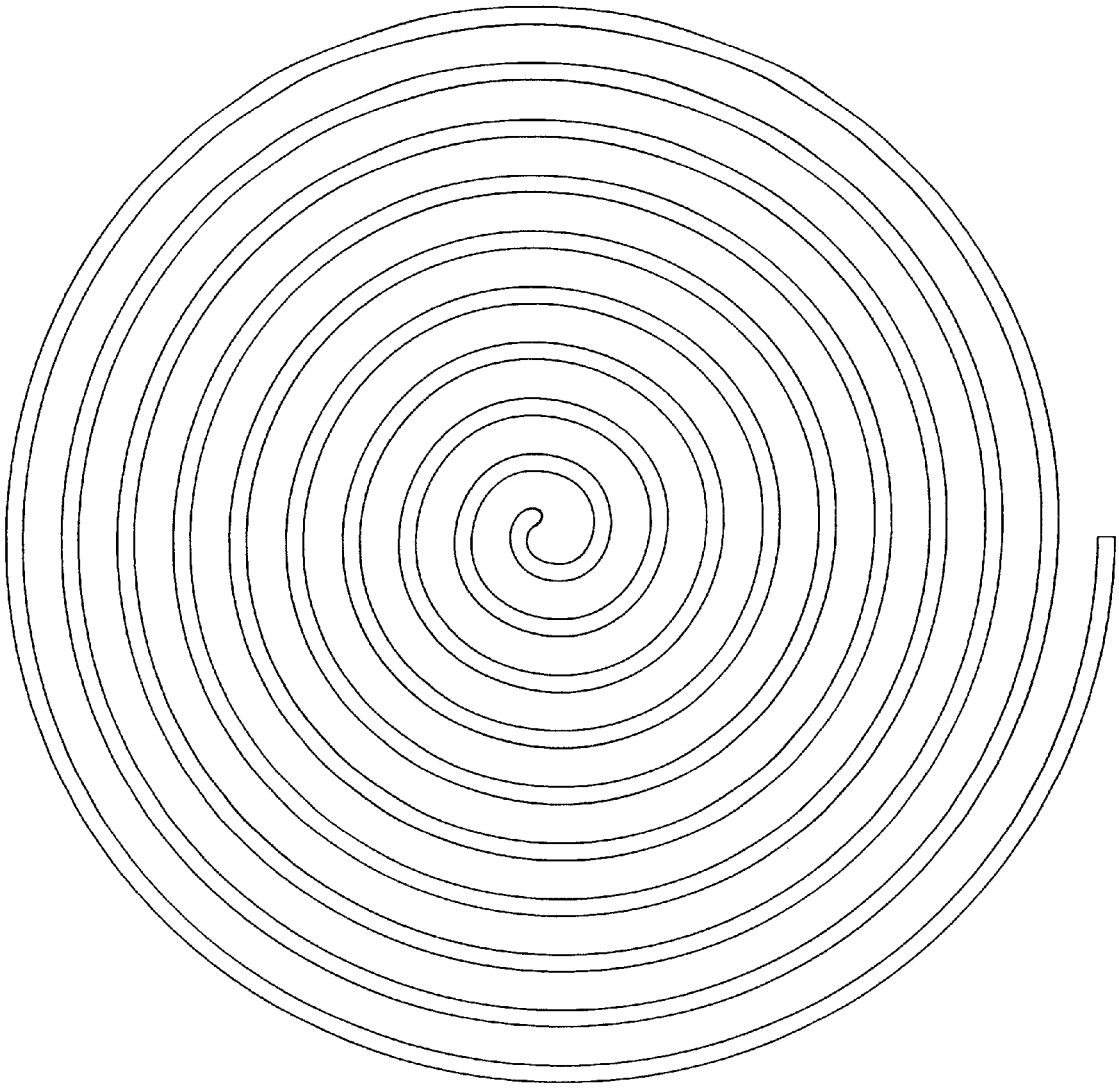
Figure 4:
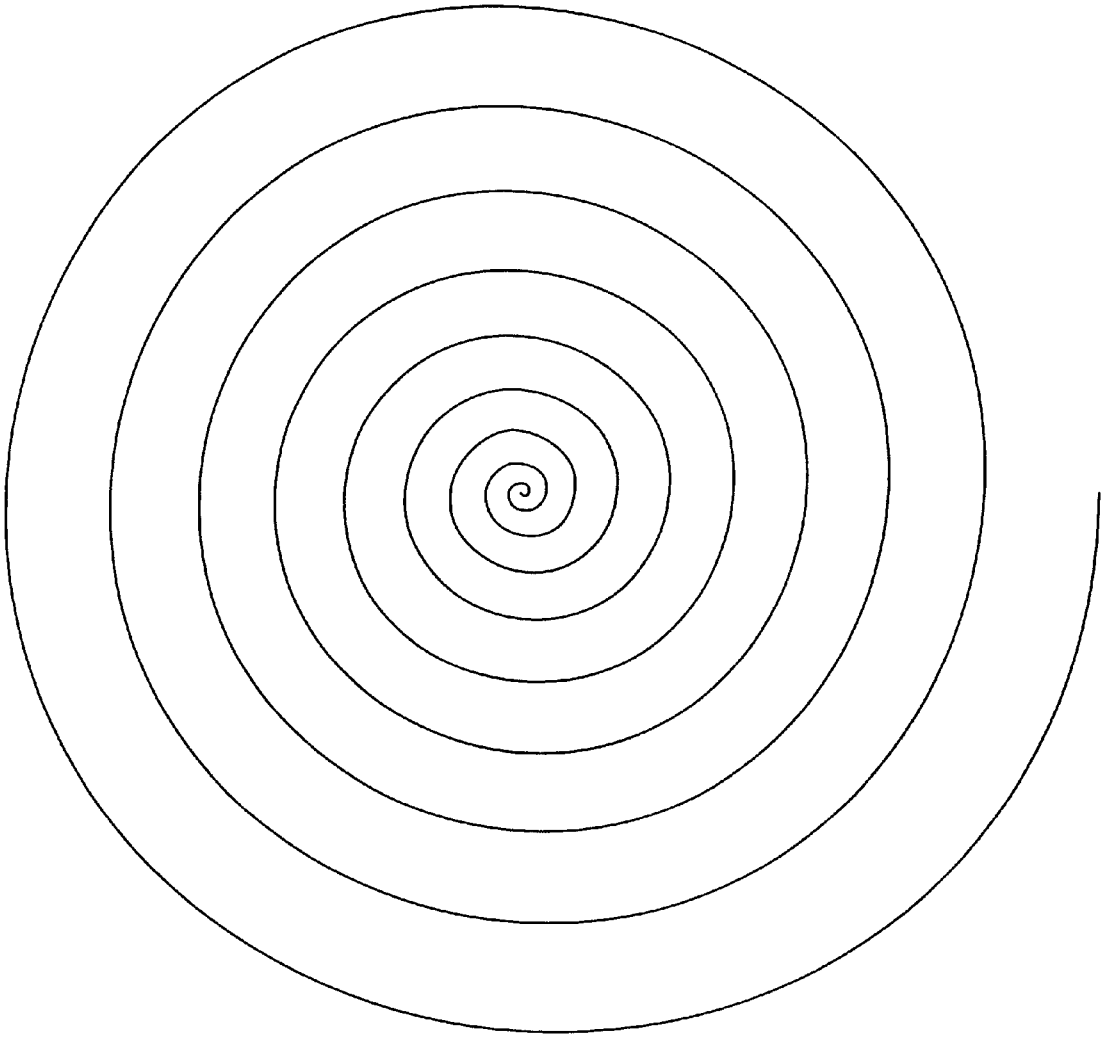
Figure 5:
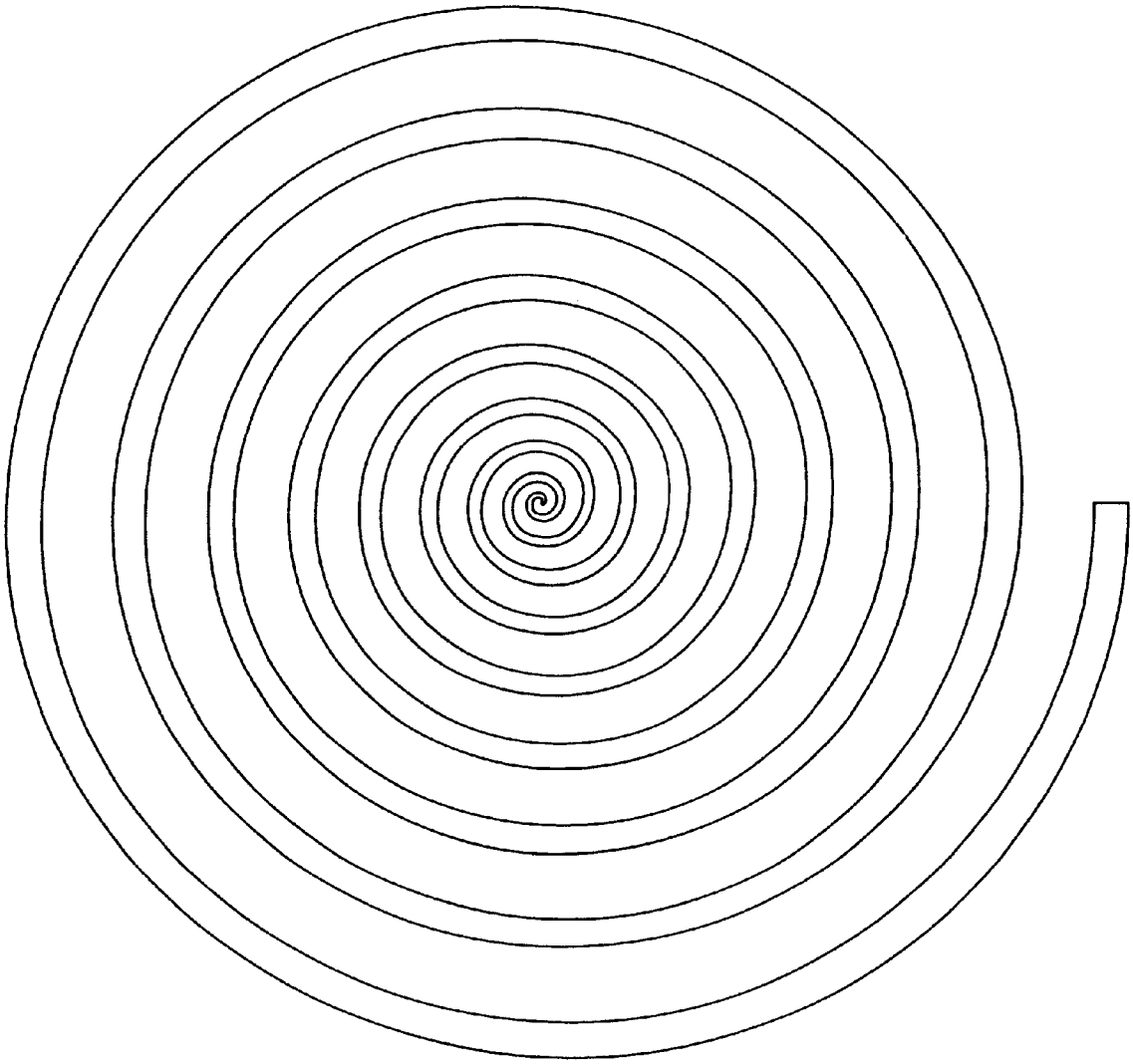
Figure 6:
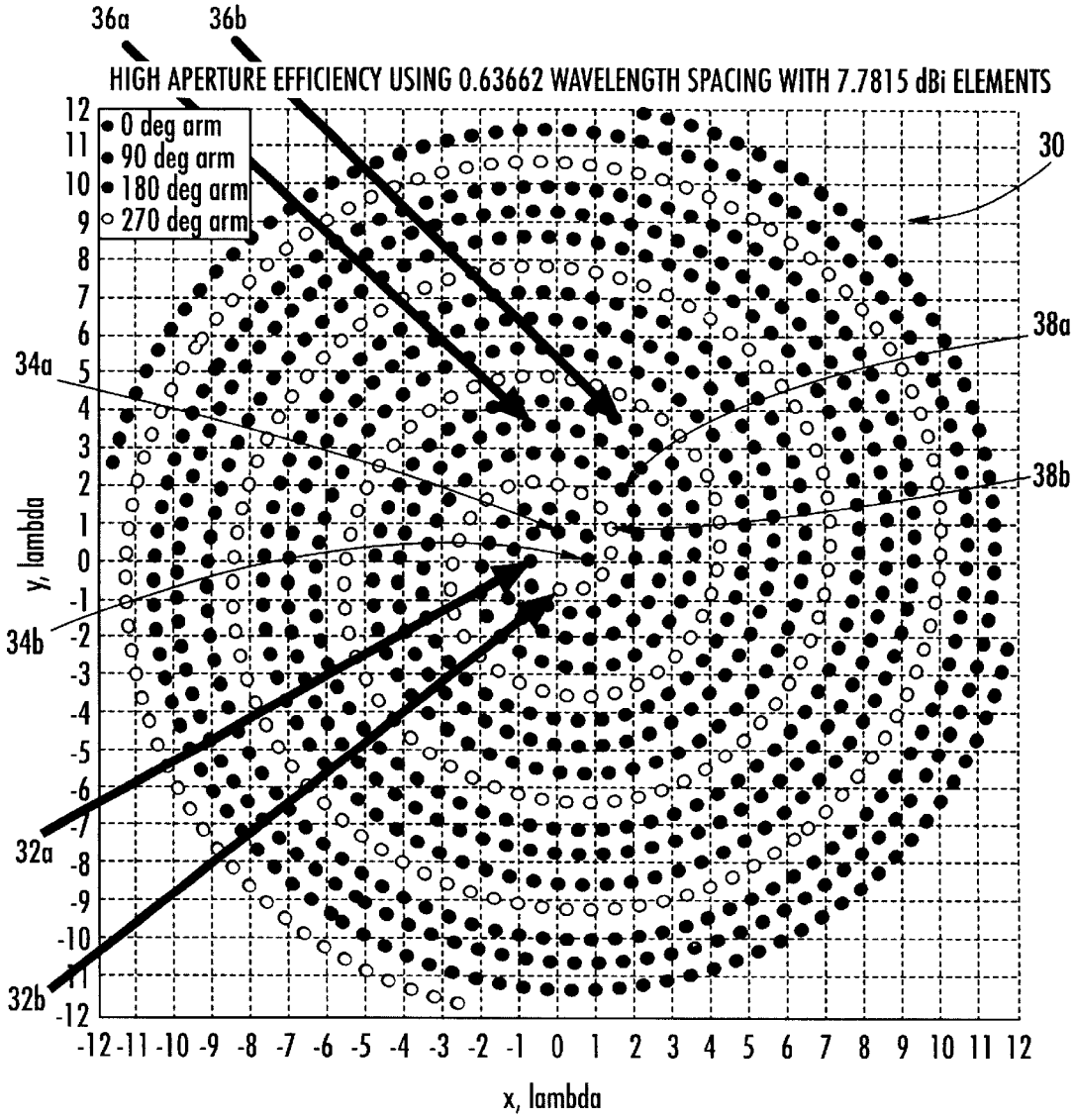
FIG. 6 is a fragmentary plan view of two balanced, series fed arrays such as shown in FIGS. 3 and 5 that are wrapped in a spiral configuration with 0, 90, 180, and 270 degree spiral arms.

In accordance with the present invention, a phased array antenna is formed as series fed antenna array 30 (FIG. 6) that is wound in a spiral as shown in the various spiral arms of FIGS. 2–5. One spiral arm is shown in FIG. 2 and depicts a closely spaced single spiral arm, with FIG. 3 illustrating the two spiral arms formed when the linear array as in FIG. 1 is wrapped about itself in a spiral with feed points positioned in the center portion and forming a balanced, series fed array. FIG. 4 shows a loosely formed single spiral arm for the spiral arms shown in FIG. 5 and forming a second, balanced, series fed array. The spiral arms combine together to form a spiral series fed array 30 as shown in FIG. 6, and showing two balanced, series fed arrays wrapped in the spiral configuration that breaks up frequency scan and grating lobes. A pair of dual feed points or four signal feed "starts" 32*a*, 32*b*, 34*a*, 34*b* are shown for each dual spiral that could be formed from two linear, series fed antennae wound in a spiral. The illustrated spiral wound series fed antenna shown in FIG. 6 has the four signal feed points or starts 32*a*, 32*b*, 34*a*, 34*b* and four spiral arms 36*a*, 36*b*, 38*a*, 38*b* with over one thousand (1,000) antenna elements. This structure forms a quad drive having dual feed points for the four starts as illustrated. This forms a simple circuit structure to feed an antenna array. The illustrated four spiral arms 36*a*, 36*b*, 38*a*, 38*b* having the four spiral signal feed starts 32*a*, 32*b*, 34*a*, 34*b* have antenna elements that are positioned on the circuit board and spiral wound to form a respective 0 degree spiral arms as 36*b*; a 90 degree spiral arm as 36*a*; a 180 degree spiral arm as 38*a*; and a 270 degree spiral arm as 38*b*. The illustrated antenna structure has a high aperture efficiency using 0.63662 wavelength spacing with 7.7815 dBi antenna elements in one non-limiting example. Numerical wavelength lamda values are shown on the respective x,y axis with respect to the positioning of the various antenna elements.

Figure 7:
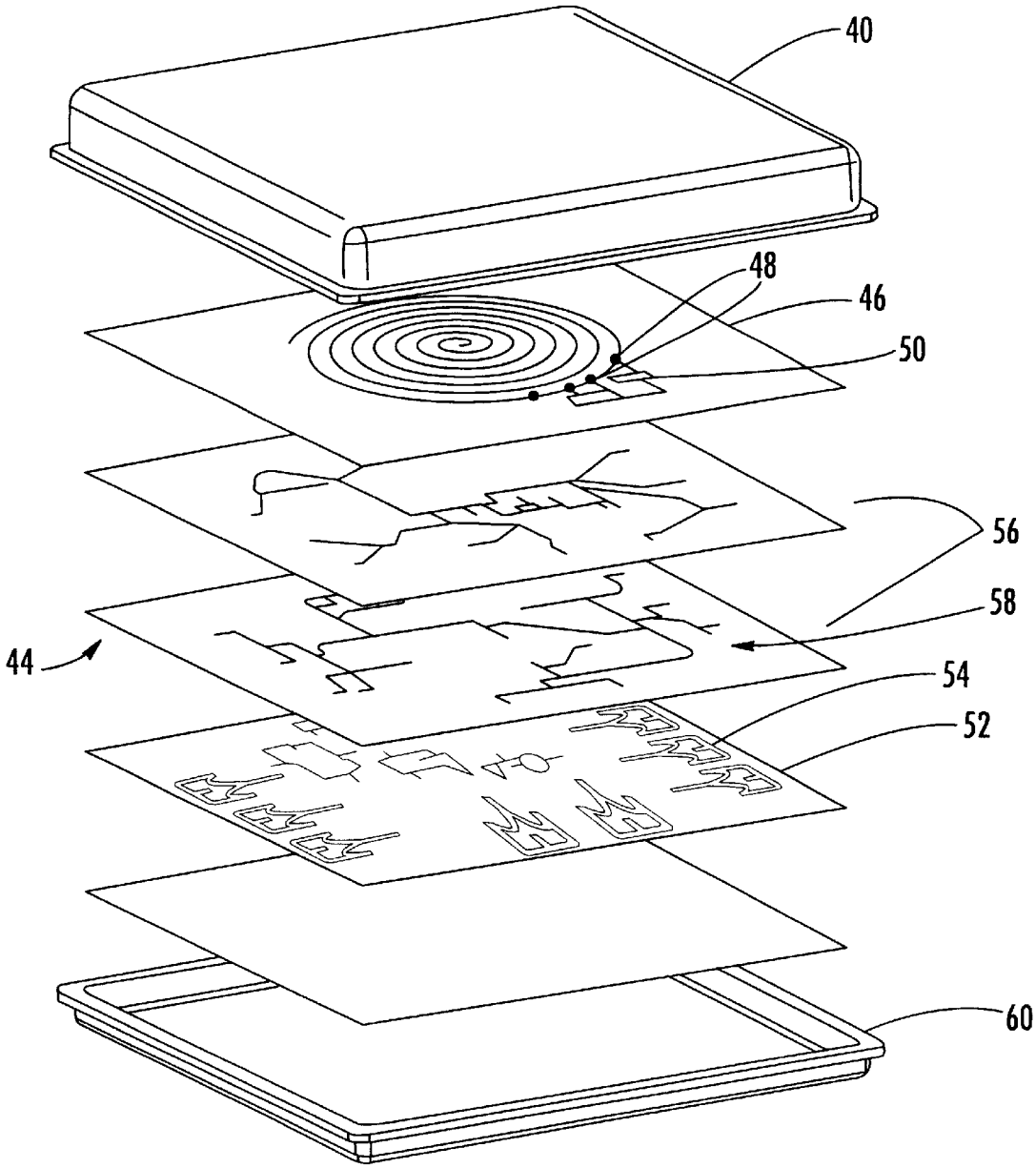
FIG. 7 is an exploded, isometric view of the series fed phased array antenna of the present invention as formed from a single, multilayer printed circuit board and showing different layers for supporting various amplifier elements, beam forming network, phase shifters and packaging components.

A non-limiting example of a lattice support structure for the antenna of the present invention is shown in FIG. 7, and could include a radome 40 and radiating antenna elements formed in the spiral configuration as a series fed array and positioned on one multilayer circuit board 44. A top layer 46 of the board includes the antenna elements 48, and in some designs, even amplifier elements 50, including low noise amplifiers (LNA) or other components. The antenna elements 48 can be surface mounted or printed by techniques known to those skilled in the art. A bottom layer portion 52 of the board can include, for instance, phase shifters, post amplification circuit elements with combiners and beam steering elements and other components 54. A middle layer portion 56 (such as two layers) can include a beam former network with power combining and signal distribution 58. Other layers can include beam control components, filtering or other components, which can exist combined on some layers or on separate layers. One or more microstrip layers are operative for conducting signals and driving the array. The layers can be formed by techniques known to those skilled in the art, including green tape layers. Mechanical packaging components 60 can include basic power supplies, cooling circuits and packaging. Such a structure can then be placed in another support structure and form part of a lattice as an integral element.

Figure 8:
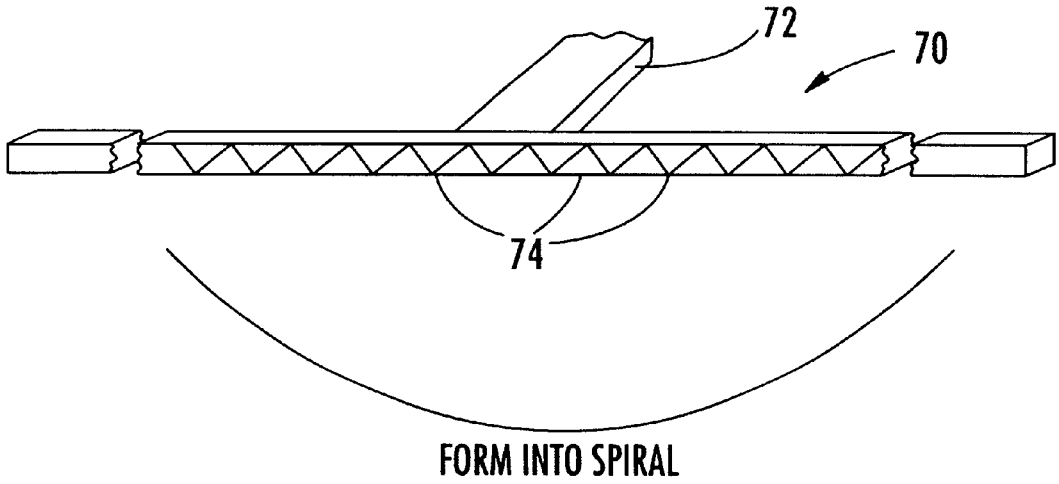
FIG. 8 illustrates a waveguide that could be configured in a spiral configuration in accordance with the present invention.

FIG. 8 illustrates a waveguide 70 such as known to those skilled in the art that can be wound in a spiral to form a spiral wound, series fed array. The waveguide 70 includes a feed 72 and a plurality of slots 74 as known to those skilled in the art. The slots 74 could be less vertical as they extend from the center portion of the waveguide. Coupling could be a function of the angle of the slot.

It is evident that the present invention now provides a series fed array antenna wrapped in a spiral configuration that is advantageous over prior art linear, series fed arrays to break up frequency scan and grating lobes.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a circuit board;

a balanced, series fed antenna array formed from a plurality of antenna elements positioned in at least two spiral antenna arms on the circuit board and having a signal feedpoint and two feed starts for a signal feedpoint positioned at a center portion of the spiral antenna arms for series feeding the antenna array and conducting any transmitted or received signals to aid in breaking up frequency scan effects and improve grating lobe suppression.

2. A phased array antenna according to claim 1, wherein said antenna array comprises two balanced series fed antenna arrays each formed as spiral antenna arms and having dual feedpoints.

3. A phased array antenna according to claim 1, wherein said circuit board comprises a microstrip layer operative with the antenna elements for series driving the antenna array.

4. A phased array antenna according to claim 1, wherein the number of antenna elements within each spiral antenna arm are substantially the same.

5. A phased array antenna according to claim 1, wherein said antenna elements comprise surface mounted antenna elements.

6. A phased array antenna according to claim 1, wherein said antenna elements comprise printed antenna elements.

7. A phased array antenna comprising:

a circuit board;

a plurality of antenna elements arranged on the circuit board as two linear, series fed antenna arranged in four spiral antenna arms as balanced, series fed antenna arrays having dual feed points for four feed starts, each feed point having two feed starts, at a center portion of the spiral arms, wherein said antenna elements are positioned in spiral arms that are formed as respective 0, 90, 180 and 270 degree spiral arms for conducting any transmitted or received signals to aid in breaking up frequency scan effects and improve grating lobe suppression.

8. A phased array antenna according to claim 7, and further comprising dual signal feed points formed at the central portion defined by said spiral antenna arms.

9. A phased array antenna according to claim 7, wherein said circuit board comprises a microstrip layer operative with the antenna elements for series driving the antenna array.

10. A phased array antenna according to claim 7, wherein the number of antenna elements within each spiral antenna arm are substantially the same.

11. A phased array antenna according to claim 7, wherein said antenna elements comprise surface mounted antenna elements.

12. A phased array antenna according to claim 7, wherein said antenna elements comprise printed antenna elements.

13. A phased array antenna comprising:

a multilayer circuit board;

a balanced, series fed antenna array formed from a plurality of antenna elements positioned in at least two spiral antenna arms on the multilayer circuit board and having a signal feedpoint and two feed starts for a signal feedpoint positioned at a center portion of the spiral antenna arms for series feeding the antenna array; and electronic circuitry supported by said multilayer circuit board and operatively connected to said antenna elements for amplifying, phase shifting and beam forming any transmitted or received signals to aid in breaking up frequency scan effects and improve grating lobe suppression.

14. A phased array antenna according to claim 13 wherein said multi-circuit board comprises a layer having amplifier elements, a layer having phase shifters, and a layer having a beam forming network.

15. A phased array antenna according to claim 13, wherein said multilayer circuit board is formed from layers of ceramic green tape.

16. A phased array antenna according to claim 13, wherein said antenna array comprises two balanced series fed antenna arrays each formed as spiral antenna arms and having dual feedpoints.

17. A phased array antenna according to claim 13, wherein said multilayer circuit board comprises a microstrip layer operative with the antenna elements through which the series fed array is driven.

18. A phased array antenna according to claim 13, wherein the number of antenna elements within each spiral antenna arm are substantially the same.

19. A phased array antenna according to claim 13, wherein said antenna elements comprise surface mounted antenna elements.

20. A phased array antenna according to claim 13, wherein said antenna elements comprise printed antenna elements.

21. A phased array antenna comprising a balanced, series fed antenna array formed from a plurality of antenna elements positioned in at least two spiral antenna arms and having a signal feedpoint and two feed starts for a signal feedpoint positioned at a center portion of the spiral antenna arms for series feeding the antenna array and conducting any transmitted or received signals to aid in breaking up frequency scan effects and improve grating lobe suppression.

22. A phased array antenna according to claim 21, wherein said spiral arms are formed from a waveguide having slots defining said antenna elements.

23. A phased array antenna according to claim 21, and further comprising a circuit board on which said antenna elements are positioned.

24. A phased array antenna according to claim 21, and further comprising electronic circuitry supported by said circuit board and operatively connected to said antenna elements for amplifying, phase shifting and beam forming any transmitted or received signals to aid in breaking up frequency scan and grating lobes.

25. A method of forming a phased array antenna comprising the steps of:

positioning a plurality of antenna elements on a circuit board in at least two spiral antenna arms and having a signal feedpoint and two feed starts for a signal feedpoint positioned at a center portion of the spiral antenna arms for series feeding the antenna array and conducting any transmitted or received signals to aid in breaking up frequency scan effects and improve rating lobe suppression.

26. A method according to claim 26, and further comprising the step of forming the circuit board as a multilayer circuit board containing interconnects and electronic components.

* * * * *